US010535300B2

(12) United States Patent
Kim et al.

(10) Patent No.: US 10,535,300 B2
(45) Date of Patent: Jan. 14, 2020

(54) ORGANIC LIGHT EMITTING DIODE (OLED) DISPLAY AND DRIVING METHOD THEREOF

(71) Applicant: LG DISPLAY CO., LTD., Seoul (KR)

(72) Inventors: Jungchul Kim, Paju-si (KR); Junyoung Kwon, Busan (KR)

(73) Assignee: LG DISPLAY CO., LTD., Seoul (KR)

( * ) Notice: Subject to any disclaimer, the term of this patent is extended or adjusted under 35 U.S.C. 154(b) by 282 days.

(21) Appl. No.: 15/188,447

(22) Filed: Jun. 21, 2016

(65) Prior Publication Data

US 2016/0379571 A1 Dec. 29, 2016

(30) Foreign Application Priority Data

Jun. 26, 2015 (KR) ..... 10-2015-0091254

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2310/08* (2013.01); *G09G 2320/0233* (2013.01); *G09G 2320/045* (2013.01)

(58) Field of Classification Search
CPC ..... G09G 3/3275; G09G 3/3291
See application file for complete search history.

(56) References Cited

U.S. PATENT DOCUMENTS

2006/0022305 A1 2/2006 Yamashita
2009/0289876 A1* 11/2009 Chun ..... G09G 3/3233 345/80
2013/0127932 A1* 5/2013 Han ..... G09G 3/3233 345/691
2014/0035799 A1 2/2014 Bae, et al.

FOREIGN PATENT DOCUMENTS

CN 1909041 A 2/2007
CN 102194405 A 9/2011
CN 103971638 A 8/2014
CN 104575372 A 4/2015
KR 10-2013-0055450 A 5/2013

OTHER PUBLICATIONS

Office Action of Chinese Patent Office in Appl'n. No. 201610463881.X, dated Jun. 4, 2018.

* cited by examiner

*Primary Examiner* — William Boddie
*Assistant Examiner* — Jeffrey Parker
(74) *Attorney, Agent, or Firm* — Dentons US LLP

(57) ABSTRACT

Provided is an organic light emitting diode (OLED) display which includes a driving circuit and pixels arranged on pixel rows. In a (j−1)-th horizontal period, the driving circuit samples a threshold voltage of a driving Transistor (DT) of each pixel arranged on the (j−1)-th pixel row, and initializes a voltage of a gate electrode of a driving TFT of each pixel arranged on the j-th pixel row. In addition, in a j-th horizontal period, the driving circuit samples a threshold voltage of the driving TFT of each pixel arranged on the j-th pixel row.

10 Claims, 8 Drawing Sheets

ORGANIC LIGHT EMITTING DIODE (OLED) DISPLAY AND DRIVING METHOD THEREOF

This application claims the benefit of Korea Patent Application No. 10-2015-0091254 filed on Jun. 26, 2015, which is incorporated herein by reference for all purposes as if fully set forth herein.

BACKGROUND

Field of the Invention

The present invention relates to an organic light emitting diode (OLED) display and a driving method thereof.

Discussion of the Related Art

An organic light emitting diode (OLED) display includes an OLED which emits light by itself and has advantages of rapid response speed, high light-emitting efficiency and brightness, and a wide field of view. Typically, an OLED has a structure illustrated in FIG. 1. The OLED includes an anode electrode, a cathode electrode, and organic compound layers formed therebetween. The organic compound layers typically include a Hole Injection Layer (HIL), a Hole Transport Layer (HTL), an Emission Layer (EML), an Electron Transport Layer (ETL), and an Electron Injection Layer (EIL). When a driving voltage is applied to the anode electrode and the cathode electrode, a hole passing through the HIL and an electron passing through the ETL move to the EML to form an exciton, and thus, the EML emits a visible light.

Such an OLED display has a plurality of pixels in a matrix, each including an OLED, and adjusts the brightness of the pixels according to the gray scale of video data. Each pixel includes at least a driving Thin Film Transistor (TFT) for controlling a driving current flowing in an OLED, a storage capacitor for controlling a gate-source voltage of the driving TFT at a constant level in one frame, and a switching TFT for programming the gate-source voltage of the TFT in response to a gate signal. The driving current is determined by the gate-source voltage of the driving TFT, which is based on the data voltage, and the brightness of each pixel is in proportion to the driving current flowing in the OLED.

In such an OLED display, the driving TFTs of the pixels may have different threshold voltages due to a process deviation or a gate-bias stress which may occur with the elapse of driving time. To address this problem, an OLED display may have a pixel structure for sampling a variation in the threshold voltages of the driving TFTs and for reducing or preventing the variation from affecting the driving current. For an existing OLED display, a sampling period is provided to sample the threshold voltage of a driving TFT before a data voltage is charged in a pixel so as to compensate for a variation in threshold voltages. As display panels with high resolutions are widely used, one horizontal period has become shorter and thus, the sampling period has become reduced. However, such a reduced sampling period may adversely affect the capability of compensating for a variation in the threshold voltages of driving TFTs as well as the quality of images displayed on the screen.

SUMMARY

Accordingly, the present disclosure is directed to an organic light emitting diode (OLED) display and a driving method thereof that substantially obviate one or more of the problems due to limitations and disadvantages of the related art.

An advantage of the present disclosure is to provide an OLED display with improved quality of images.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present disclosure, as embodied and broadly described herein, an organic light emitting diode (OLED) display may, for example, include a plurality of pixels arranged on n number of pixel rows including a j-th pixel row, wherein n and j are integers and j is equal to or smaller than n; and a driving circuit comprising a gate driver that supplies a scan signal to each pixel row and a data driver that supplies data voltages to pixels arranged on a pixel row supplied with the scan signal, wherein, in a (j−1)-th horizontal period during which the scan signal is supplied to a (j−1)-th pixel row, the driving circuit samples a threshold voltage of a driving transistor in each pixel arranged on the (j−1)-th pixel row, and initializes a voltage of a gate electrode of a driving transistor in each pixel arranged on the j-th pixel row.

In another aspect, an organic light emitting diode (OLED) display may, for example, include a display panel, a gate driver, and a data driver. The display panel includes a plurality of pixels, and first and second scan lines, emission lines, a reference voltage line, and a data line which are connected to the pixels. The gate driver supplies first and second scan signals to the first and second scan lines, respectively, and supplies an emission signal to the emission lines. The data driver supplies a data voltage to the data lines. Each of the pixels includes a driving Thin Film Transistor (TFT), first to fifth transistors, and a storage capacitor. The driving transistor includes a gate electrode connected to a node A, a source electrode connected to a node B, and a drain electrode connected to a high-potential driving voltage input terminal. The first transistor is connected to the nodes A and B and turned on by a first scan signals input through a first scan line. The second transistor is connected to the node B and a node C connected to an anode electrode of an OLED, and turned on by an emission signal input through an emission line. The third transistor is connected to the node C and a reference voltage line and turned on by a first scan signal. The fourth transistor is connected to a node D and the reference voltage line and turned on by an emission signal. The fifth transistor is connected to the node D and a data line and turned on by a second scan signal input through a second scan line. The storage capacitor includes a first electrode connected to the node A, and a second electrode connected to the node D. The gate driver supplies the first and second scan signals to the first and second signals, respectively, and supplies emission signals to the emission lines.

In yet another aspect, a driving method of an organic light emitting diode (OLED) display in which a plurality of pixels are arranged on n number of pixel rows including a j-th pixel row, wherein n and j are integers and j is equal to or smaller than n, the driving method may, for example, include in a (j−1)-th horizontal period during which a scan signal is supplied to a (j−1)-th pixel row, a threshold voltage of a driving thin film transistor (TFT) of each pixel arranged on the (j−1)-th pixel row is sampled, and a voltage of a gate electrode of a driving TFT of each pixel arranged on the j-th pixel row is initialized; in a j-th horizontal period during which the scan signal is supplied to the j-th pixel row, a threshold voltage of the driving TFT of each pixel arranged on the j-th pixel row is sampled, and a data voltage is charged in each pixel arranged on the j-th pixel row; and in a (j+1)-th horizontal period during which the scan signal is supplied to a (j+1)-th pixel row, an OLED in each pixel arranged on the j-th pixel row is caused to emit a light according to the data voltage charged.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the present invention, examples of which are illustrated in the accompanying drawings.

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Figure 2:
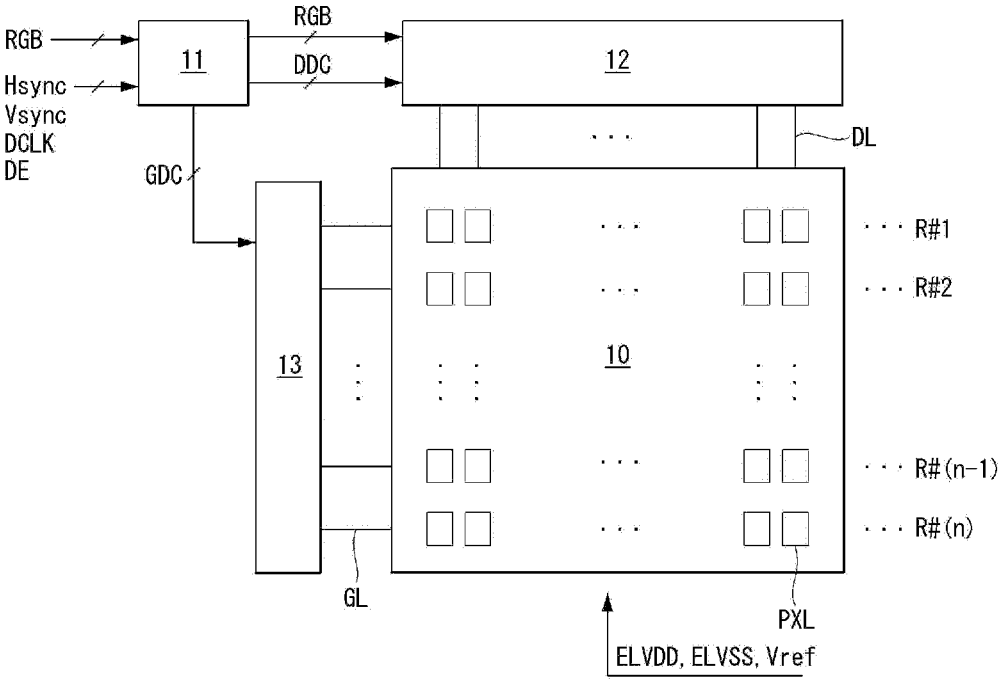
FIG. 2 is a diagram illustrating an OLED display according to an embodiment of the present disclosure.
Figure 3:
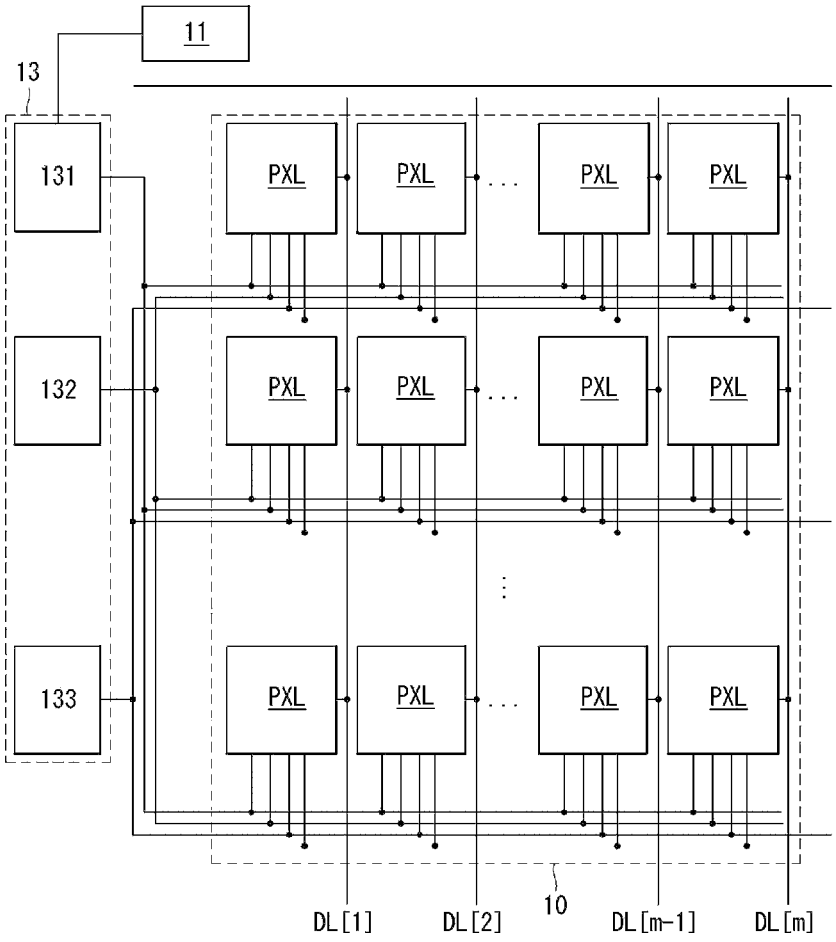
FIG. 3 is a mimetic diagram illustrating a connection structure of a pixel array according to an embodiment of the present disclosure.

FIG. 2 is a diagram illustrating an organic light emitting diode (OLED) display according to the first embodiment of the present disclosure, and FIG. 3 is a connected relationship between a pixel array and a gate driver according to an embodiment of the present disclosure.

Referring to FIG. 2, an OLED display according to the first embodiment of the present disclosure includes a display panel 10 in which a plurality of pixels PXL are arranged in a matrix, a data driver 12 for driving data lines DL, a gate driver 13 for driving gate lines GL, and a timing controller 11 for controlling operation timings of the data driver 12 and the gate driver 13.

The display panel 10 includes the pixels PXL arranged on n number of pixel rows (R#j) and m number of pixel columns, first to m-th data lines DL1~DL[m], and the gate lines GL. The gate lines GL include n number of first scan lines SL1, n number of second scan lines SL2, first to n-th emission lines EL[1]~EL[n]. The k-th data line DL[k] is connected to pixels on the k-th row. The j-th first scan line SL1[j] and the j-th second scan lines SL2[j] are connected to the j-th pixel row R#j, wherein "j" is a natural number smaller than n. The j-th emission line EL[j] is connected to pixels on the j-th pixel row R#j.

The pixels PXL may be supplied with a power generator (not illustrated) with a high-potential driving voltage EVDD, a low-potential driving voltage EVSS, an initial voltage Vinit, and a reference voltage Vref. To reduce or prevent an undesired emission of the OLED, the initial voltage Vinit is beneficially selected from a voltage sufficiently lower than the low-potential driving voltage EVSS.

Each transistor of a pixel PXL may be an oxide transistor including an oxide semiconductor layer. An oxide transistor is advantageous in manufacturing a large-area display panel 10, when electron mobility, process deviation, and the like are considered. However, the present disclosure is not limited thereto, and a semiconductor layer of the transistor may be made of amorphous silicon, poly-silicon, or the like.

Each pixel PXL includes a plurality transistors and storage capacitors in order to compensate for a variation in a threshold voltage of a driving Thin Film Transistor (TFT). A pixel structure according to an embodiment of the present disclosure will be later described in detail The timing controller 11 rearranges externally-received digital video data RGB to fit a resolution of the display panel 10, and supplies the rearranged digital video data RGB to the data driver 12. In addition, the timing controller 11 generates a data control signal DDC and a gate control signal GDC for controlling operation timings of the data driver 12 and the gate driver 13 based on timing signals, such as a vertical sync signal Vsync, a horizontal sync signal Hsync, a dote clock signal DCLK, and a data enable signal DE.

Based on a data control signal DDC, the data driver 12 converts digital video data RGB, which were received from the timing controller 11, into analog data voltages. The data driver 12 supplies the data voltages to the data lines DL.

The gate driver 13 generates a scan signal and an emission signal based on a gate control signal GDC. The gate driver 13 sequentially supplies a scan signal to the scan lines SL, and sequentially supplies an emission signal EM[j] to emission lines EL. That is, the gate driver 13 sequentially supplies a scan signals SCAN to the first to n-th scan lines SL, and sequentially supplies an emission signal EM[j] to the first to n-th emission lines EL. The gate driver 13 may be formed directly in a non-display area of the display panel 10 by a Gate-driver In Panel (GIP) method.

The gate driver 13 may include a first scan driver 131 for driving n number of the first scan lines SL1[1]~SL1[n] (herein, "n" is a natural number), a second scan driver 132 for driving n number of the second scan lines SL2[1]~SL2[n], and an emission driver 133 for driving n number of emission lines EL[1]~EL[n]. The first scan driver 131 generates a first scan signal SCAN1, and sequentially supplies the first scan signal SCAN1 to the first scan lines SL1[1]~SL1[n]. The second scan driver 132 generates a second scan signal SCAN2, and sequentially supplies the second scan signal SCAN2 to the second scan lines SL2[1]~SL2[n]. The emission driver 133 generates an emission signal EM, and sequentially supplies the emission signal EM to the emission lines EL[1]~EL[n].

Figure 4:
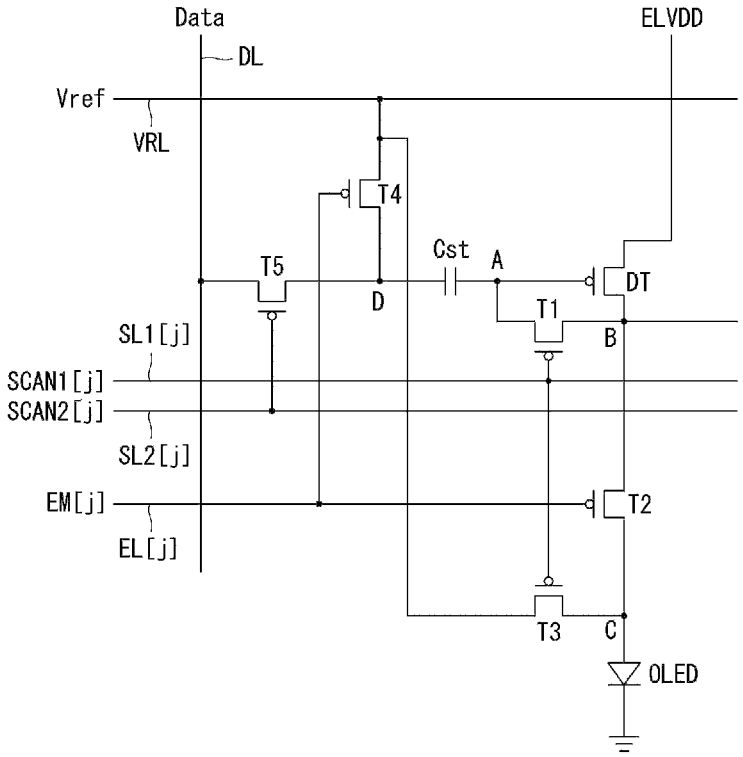
FIG. 4 is a diagram illustrating an equivalent circuit diagram of a pixel structure according to the first embodiment of the present disclosure.
Figure 5:
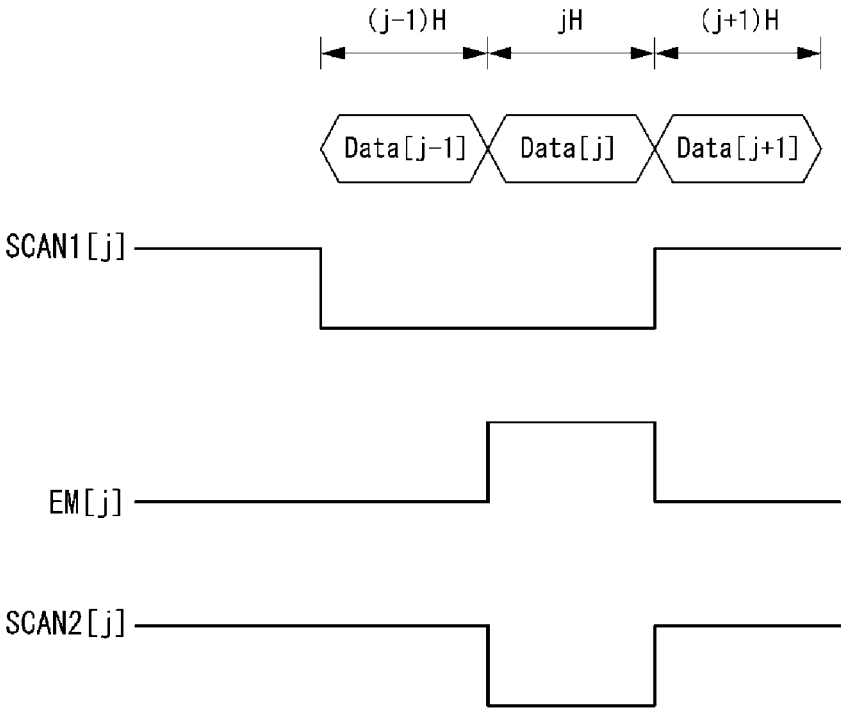
FIG. 5 is a diagram illustrating an example of a gate signal applied to a pixel according to an embodiment of the present disclosure.

FIG. 4 is a diagram illustrating a pixel structure according to an embodiment of the present disclosure, and FIG. 5 is a diagram illustrating a driving signal supplied to a pixel illustrated in FIG. 4.

Referring to FIG. 4, a pixel PXL[j,k], which is arranged on the j-th pixel row and the k-th pixel column, will be described in detail by way of example.

The pixel PXL[j,k] includes an OLED, a driving TFT (DT), first to fifth transistors (T1 to T5), and a storage capacitor C. Each transistor is a P-type transistor, but a semiconductor type of each transistor is not limited thereto. In a case where the first to fifth transistors (T1 to T5) are N-type transistors, the gate signals SCAN1[j], SCAN2[j], and EM[j] shown in FIG. 5 are beneficially reversed.

Figure 1:
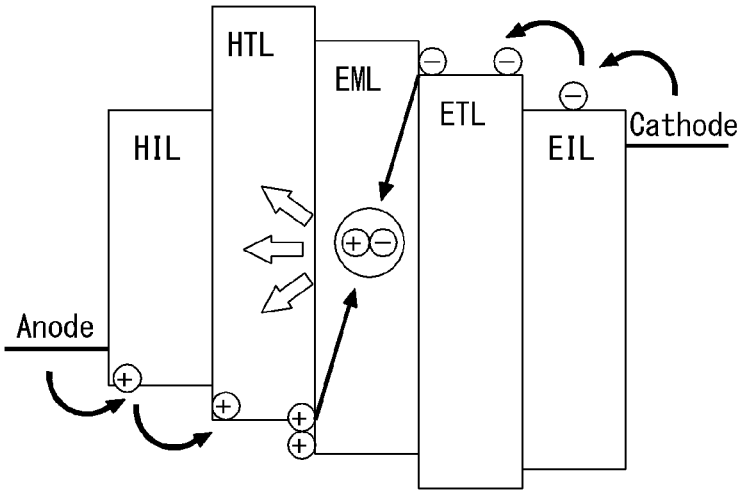
FIG. 1 is a diagram illustrating an organic light emitting diode (OLED) and a light-emitting principle thereof.

An OLED emits light in accordance with an amount of driving current supplied by the driving TFT (DT). As illustrated in FIG. 1, a plurality of organic compound layers are formed between an anode electrode and a cathode electrode of the OLED. The plurality of organic compound layers include a Hole Injection Layer (HIL), a Hole Transport Layer (HTL), an Emission Layer (EML), an Electron Transport Layer (ETL), and an Electron Injection Layer (EIL). The anode electrode of the OLED is connected to a node D, and the cathode electrode of the OLED is connected to a low-potential driving voltage (EVSS) input terminal Based on its gate-source voltage Vgs, the driving TFT (DT) controls a driving current which is to be applied to the OLED. The driving TFT (DT) includes a gate electrode connected to a node A, a source electrode connected to a node B, and a drain electrode connected to a high-potential driving voltage (ELVDD) input terminal.

First and second electrodes of the first transistor (T1) are connected to the nodes A and B, respectively, and a gate electrode of the first transistor (T1) is connected to the first scan line SL1. That is, the first transistor (T1) is turned on by the first scan signal SCAN1 to be connected to the nodes A and B.

First and second electrodes of the second transistor (T2) are connected to the nodes B and C, respectively, and a gate electrode of the second transistor (T2) is connected to the emission line EL[j]. That is, in response to the emission signal EM[j], the second transistor (T2) connects the driving TFT (DT) and the OLED.

First and second electrodes of the third transistor (T3) are connected to the node B and the OLED, respectively, and a gate electrode of the third transistor (T3) is connected to the j-th emission line EL[j]. That is, in response to the j-th emission signal EM[j], the third transistor (T3) connects the driving TFT (DT) and the OLED.

First and second electrodes of the fourth transistor (T4) are connected to the node D and a reference voltage line VRL, and a gate electrode of the fourth transistor (T4) is connected to the emission line EL[j]. That is, in response to the emission signal EM, the fourth transistor (T4) supplies a reference voltage to the node D.

First and second electrodes of the fifth transistor (T5) are connected to a data line DL[k] and the node D, respectively, and a gate electrode of the fifth transistor (T5) is connected to the second scan line SL2. That is, in response to the second scan signal SCAN2[j], the fifth transistor (T5) supplies a data voltage Vdata to the node D.

The storage capacitor C is connected between the nodes A and D. The storage capacitor C is used to sample a threshold voltage of the driving TFT (DT) in a source-follower method.

Figure 6A:
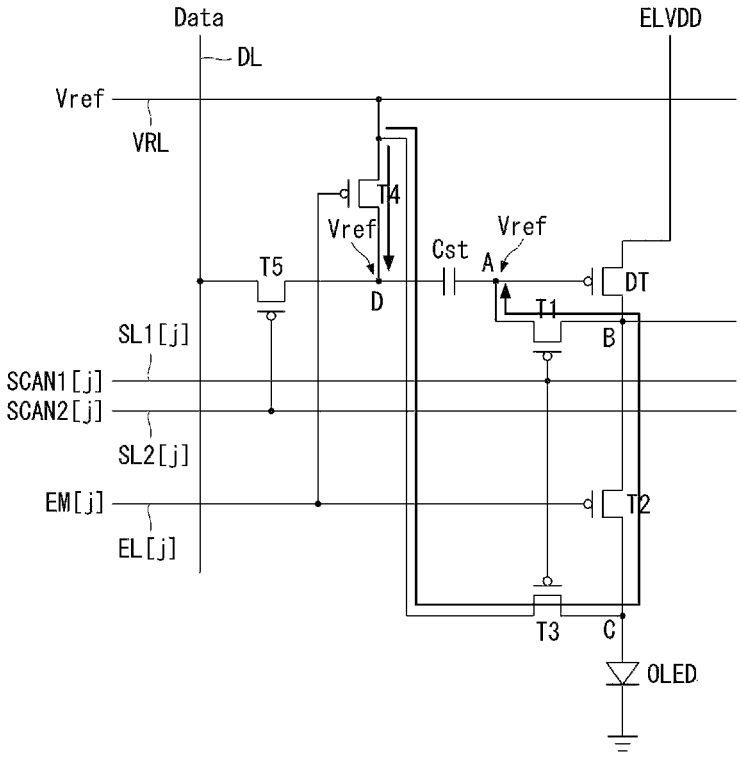
FIG. 6A is an equivalent circuit diagram of a pixel corresponding to an initialization period according to an embodiment of the present disclosure.
Figure 6B:
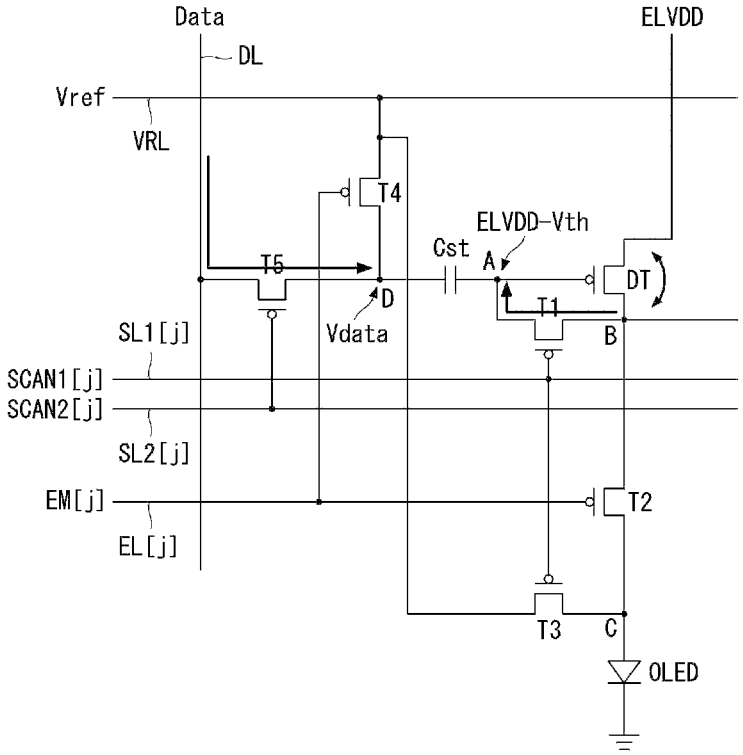
FIG. 6B is an equivalent circuit diagram of a pixel corresponding to a sampling period according to an embodiment of the present disclosure.
Figure 6C:
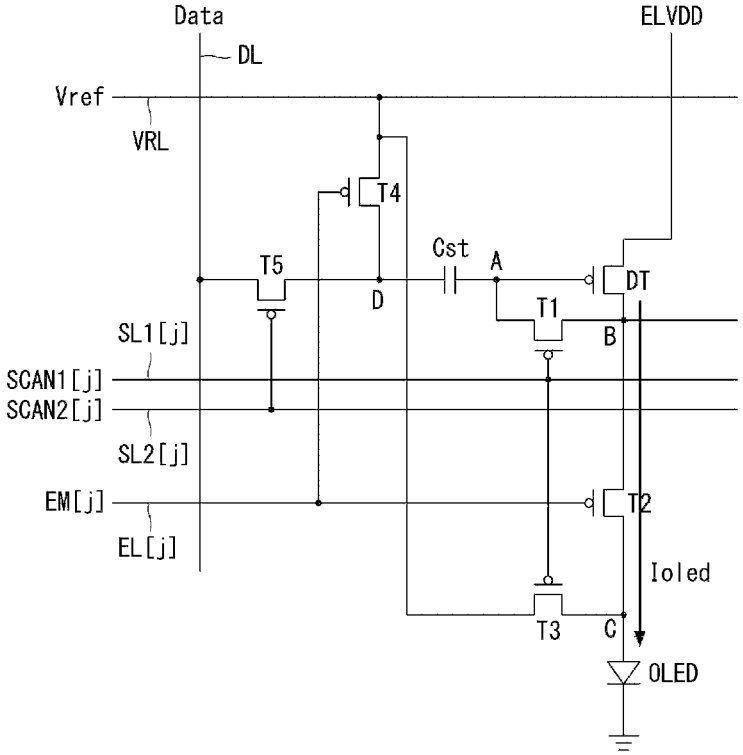
FIG. 6C is an equivalent circuit diagram of a pixel corresponding to during a light-emitting period according to an embodiment of the present disclosure.

An operation of each pixel arranged on the j-th pixel row in the first embodiment is described with reference to FIGS. 5 and 6A to 6C, and [Table 1] described below. FIGS. 6A to 6C are equivalent circuit diagrams of a pixel in accordance with a driving signal, and [Table 1] shows a phase of each node in a different operation period of pixels.

The first to fifth transistors (T1 to T5) are N-type transistors in the first embodiment so that a low-level voltage of each driving signal indicates a turn-on voltage of the first to fifth transistors, and a high-level voltage indicates a turn-off voltage of the first to fifth transistors.

An operation timing of each pixel is divided into an initialization period Ti, a sampling period Ts, and a light-emitting period Te. The initialization period Ti is a time period for initializing a voltage of the node A connected to the gate electrode of the driving TFT (DT). During the initialization period Ti, a reference voltage Vref may be used as a voltage that initializes the node A. The sampling period Ts is a time period for sampling a threshold voltage of the driving TFT (DT) and for charging a data voltage Vdata to the node D which is connected to a storage capacitor Cst. The light-emitting period Te is a time period for causing the OLED to emit light without affecting the threshold voltage.

Each of the initialization period Ti, the sampling period Ts, and the light emitting period Te is performed in one horizontal period 1H. The j-th horizontal period jH may be defined as a time period in which the j-th scan signal SCAN[j] is supplied to the j-th pixel row (R#j).

TABLE 1

| | Initialization period | Sampling period | Light-emitting period |
|---|---|---|---|
| Node A | Vref | ELVDD-Vth | ELVEE-Vth(Vdata-Vref) |
| Node B | Vref | Vref | Vdata |

The initialization period Ti of pixels arranged on the j-th pixel row is performed in the (j−1)-th horizontal period [j−1]H in which a data voltage is supplied to the the (j−1)-th pixel row. In the initialization period Ti, the first scan signal SCAN1 of ON level and the emission signal EM of ON level are input, and the second scan signal SCAN2 of OFF level is input. Accordingly, the fourth transistor (T4) is turned on by the emission signal EM[j] to charge a reference voltage Vref to the node D. The first transistor (T1) and the third transistor (T3) are turned on by the second scan signal SCAN2[j], and the second transistor (T2) is turned on by the emission signal EM[j]. Accordingly, the first to third transistors (T1) to (T3) connect the reference voltage line VRL and the node A in the initialization period Ti, and thus, the node A is charged with the reference voltage Vref.

The sampling period Ts is performed in the j-th horizontal period jH in which a data voltage is input to pixels arranged on the j-th pixel row. In the sampling period Ts, the first scan signal SCAN1 and the second scan signal SCAN2[j] are changed to an ON level voltage, while the emission signal EM[j] is changed to an OFF level voltage. As the emission signal EM[j] is changed to a low level voltage, the second transistor (T2) is turned off and a current path between the nodes B and C is cut off. In the sampling period Ts, the first transistor (T1) is turned on by the first scan signal SCAN1, and the nodes A and B are connected to each other. Accordingly, the nodes A and B are in a diode connection, and the node A is charged to an "ELVDD-Vth"-level voltage which corresponds to a difference between the high-potential driving voltage ELVDD and a threshold voltage of the driving TFT (DT). In the sampling period Ts, the fifth transistor (T5) is turned on by the second scan signal SCAN2[j], so that a data voltage supplied from the data lines DL is charged into the node D.

The light-emitting period Te starts after a programing period Tp and ends before the initialization period Ti of the next frame. In the light-emitting period Te, the first scan signal SCAN1 and the second scan signal SCAN2 are changed to an Off level voltage, and the emission signal EM[j] is changed to an ON level voltage. The fourth transistor (T4) is turned on by the emission signal EM[j] to charge the reference voltage Vref to the node D. Accordingly, the node D, which was charged to the data voltage Vdata in the sampling period Ts, is charged to the reference voltage Vref in the light-emitting period Te. That is, when the sampling period Ts proceeds into the light-emitting period Te, a voltage level of the node D is changed as much as "Vdata-VRef" which corresponds to a difference between the data voltage Vdata and the reference voltage Vref. In response to the change in the voltage level of the node D, a voltage level of the node A is changed. That is, with "Vdata−Vref" being reflected, the voltage level of the node A is changed from "ELVDD−Vth" to "ELVDD−Vth−(Vdata−Vref)."

A driving current Ioled flowing in the OLED in the light-emitting period Te is represented by Equation 1.

$$Ioled=(k/2)(Vsg-Vth)\hat{}2=(k/2)(ELVDD-ELVDD+Vth+Vdata-Vref-Vth)\hat{}2=(k/2)(Vdata-Vref)\hat{}2, \quad \text{[Equation 1]}$$

wherein k denotes a proportional factor which is determined by an electron mobility, a parasitic capacitance, and a channel capacity of the driving TFT (DT).

The OLED emits light based on the above driving current equation, and thereby, is capable of displaying a desired gray scale. As shown in Equation 1, the driving current Ioled of the OLED is k/2(Vsg−Vth)^2, but Vsg programmed in the programming period Tp already includes a component corresponding to Vth. Thus, Vth is removed from the final equation for the driving current Ioled, (k/2)(Vdata−Vref)^2. In other words, any change in the threshold voltage may not affect the driving current Ioled.

In the OLED display according to an embodiment of the present disclosure, the initialization period of the j-th pixel row overlaps the sampling period of the (j−1)-th pixel row. That is, each of the initialization period and the sampling period is performed in one horizontal period 1H. In the first embodiment, the initialization period and the sampling period of the driving TFT are performed in different horizontal periods, so that a sufficiently long sampling period may be secured, and thus, a threshold voltage of the driving TFT may be compensated efficiently, thereby efficiently addressing brightness distortion.

Figure 7:
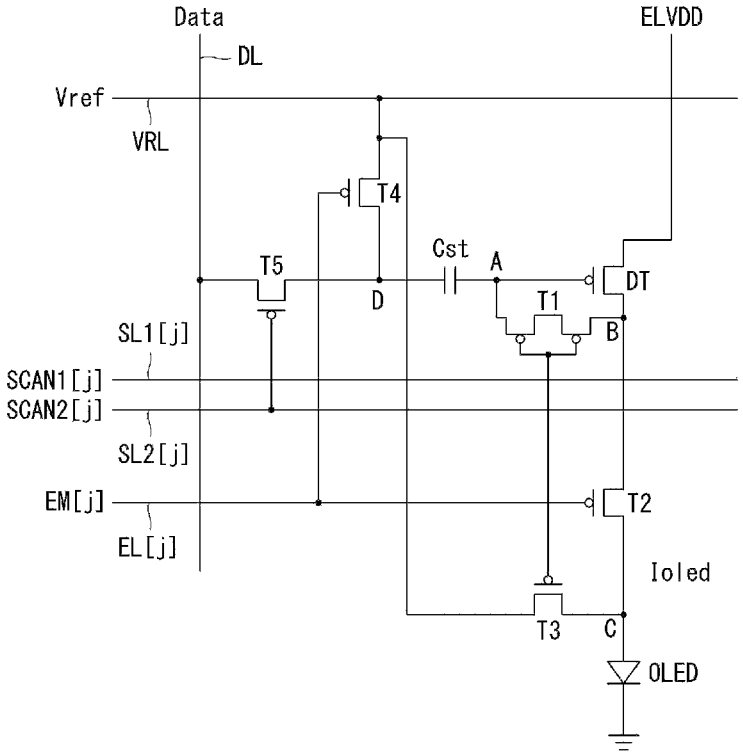
FIG. 7 is an equivalent circuit diagram of a pixel structure according to the second embodiment of the present disclosure.

FIG. 7 is a diagram illustrating a pixel structure according to the second embodiment of the present disclosure.

Referring to FIG. 7, a pixel PXL[j,k], which is arranged on the j-th pixel row and the k-th pixel column, is described in detail by way of example. Hereinafter, components substantially identical to those described in the first embodiment will not be described in detail.

The pixel PXL[j,k] includes an OLED, a driving TFT (DT), first to fifth transistors (T1 to T5), and a storage capacitor C. Each transistor is a P-type transistor, but a semiconductor type of each transistor is not limited thereto. In a case where the first to fifth transistors (T1 to T5) are N-type transistors, the gate signals SCAN1[j], SCAN2[j], and EM[j] illustrated in FIG. 5 are beneficially reversed.

The OLED emits light by a diving current supplied from the driving TFT (DT). Based on its own gate-source voltage Vgs, the driving TFT (DT) controls a driving current which is to be applied to the OLED. The driving TFT (DT) includes a gate electrode connected to a node A, a source electrode connected to a node B, and a drain electrode connected to a high-potential driving voltage (ELVDD) input terminal.

First and second electrodes of the first transistor (T1) are connected to the nodes A and B, respectively, and a gate electrode of the first transistor (T1) is connected to a first scan line SL1. That is, the first transistor (T1) is turned on by the first scans signal SCAN1 to connect the nodes A and B to each other. The first transistor (T1) may be in a double-gate structure to reduce a leakage current. In a case where a leakage current occurs when the first transistor (T1) is turned off, a phase of the storage capacitor C is changed. If the phase of the storage capacitor C is changed, a gate-source phase of the driving TFT (DT) is changed. Since the gate-source phase of the driving TFT (DT) determines a brightness of the OLED, a leakage current of the first transistor (T1) affects brightness. Therefore, as the first transistor (T1) connected to the storage capacitor C is provided in a double-gate structure, it is possible to reduce a leakage current of the first transistor (T1) and to reduce or prevent brightness distortion.

First and second electrodes of the second transistor (T2) are connected to the nodes B and C, respectively, and a gate electrode of the second transistor (T2) is connected to an emission line EL[j]. That is, in response to an emission signal EM[j], the second transistor (T2) connects the driving TFT (DT) and the OLED.

First and second electrodes of the third transistor (T3) are connected to the node B and the OLED, respectively, and a gate electrode of the third transistor (T3) is connected to the j-th emission line EL[j]. That is, in response to the j-th emission signal EM[j], the third transistor (T3) connects the driving TFT (DT) and the OLED.

First and second electrodes of the fourth transistor (T4) are connected to a node D and a reference voltage line VRL, respectively, and a gate electrode of the fourth transistor (T4) is connected to an emission line EL. That is, in response to an emission signal EM, the fourth transistor (T4) supplies a reference voltage Vref to the node D.

First and second electrodes of the fifth transistor (T5) are connected to a data line DL and the node D, respectively, and a gate electrode of the fifth transistor (T5) is connected to a second scan line SL2. That is, in response to a second scan signal SCAN[j], the fifth transistor (T5) supplies a data voltage Vdata to the node D.

The storage capacitor C is connected between the nodes A and D. The storage capacitor C is used to sample a threshold voltage of the driving TFT(DT) in a source-follower method.

The second embodiment shows a case in which the first transistor (T1) is in a double-gate structure. When a leakage current is present in a transistor connected to the storage capacitor C, a brightness distortion may occur. For this reason, other transistors connected to the storage capacitor C may be also in a double-gate structure. For example, although not illustrated in the drawings, even the fourth transistor (T4) may be also formed in a double-gate structure. In another example, either the first transistor (T1) or the fourth transistor (T4) may be formed in a double-gate structure.

By way of example, gate structures of the first transistor (T1) and the fourth transistor (T4) may be selected as one of the following examples listed in [Table 2].

TABLE 2

| First Transistor | Fourth Transistor |
|---|---|
| Single Gate | Single Gate |
| Single Gate | Double-gate |
| Double-gate | Single Gate |
| Double-gate | Double-gate |

As described above, an OLED display according to an embodiment of the present disclosure samples a threshold voltage of a driving TFT in a previous horizontal period to secure a sufficient sampling time so as to compensate for the threshold voltage of the driving TFT efficiently.

In addition, transistors connected to a storage capacitor are formed in a double-gate structure so as to reduce or prevent brightness distortion which may occur due to a leakage current.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode (OLED) display comprising:

a display panel in which a plurality of pixels arranged on n number of pixel rows including a j-th pixel row, wherein n and j are integers and j is equal to or smaller than n, first to second scan lines connected to pixels in each pixel row, an emission line, a reference voltage line, and a data line are arranged; and a driving circuit comprising a gate driver that supplies a scan signal to each pixel row through the first and second scan lines respectively, and that supplies an emission signal to the emission line and a data driver that supplies data voltages to the data line, wherein each of the plurality of pixels comprises:

a driving Transistor (DT) including a gate electrode connected to a node A, a source electrode connected to a node B, and a drain electrode connected to a high-potential driving voltage input terminal;

a first transistor connected to the node A and a node B, and capable of being turned on turned on by the first scan signal received through the first scan line;

a second transistor connected to the node B and a node C connected to an anode electrode of an OLED, and capable of being turned on by the emission signal received through the emission line;

a third transistor connected to the node C and the reference voltage line, and capable of being turned on by the first scan signal;

a fourth transistor connected to the node D and the reference voltage line, and capable of being turned on by the emission signal;

a fifth transistor connected to the node D and the data line, and capable of being turned on by the second scan signal received through the second scan line; and a storage capacitor including a first electrode connected to the node A, and a second electrode connected to a node D; and wherein, in a (j−1)-th horizontal period during which the scan signal is supplied to a (j−1)-th pixel row, the driving circuit samples a threshold voltage of the driving transistor in each pixel arranged on the (j−1)-th pixel row, and initializes a voltage of the gate electrode of the driving transistor in each pixel arranged on the j-th pixel row.

2. The OLED display of claim 1, wherein, in a j-th horizontal period during which the scan signal is supplied to the j-th pixel row, the data driver supplies the data voltage to pixels arranged on the j-th pixel row.

3. An organic light emitting diode (OLED) display comprising:

a display panel in which a plurality of pixels arranged on n number of pixel rows including a j-th pixel row, wherein n and j are integers and j is equal to or smaller than n, first to second scan lines connected to pixels in each pixel row, an emission line, a reference voltage line, and a data line are arranged;

a gate driver that supplies first and second scan signals to the first and second scan lines, respectively, and that supplies an emission signal to the emission line; and a data driver that supplies a data voltage to the data line, wherein each of the plurality of pixels comprises:

a driving Transistor (DT) including a gate electrode connected to a node A, a source electrode connected to a node B, and a drain electrode connected to a high-potential driving voltage input terminal;

a first transistor connected to the node A and a node B, and capable of being turned on turned on by the first scan signal received through the first scan line;

a second transistor connected to the node B and a node C connected to an anode electrode of an OLED, and capable of being turned on by the emission signal received through the emission line;

a third transistor connected to the node C and the reference voltage line, and capable of being turned on by the first scan signal;

a fourth transistor connected to the node D and the reference voltage line, and capable of being turned on by the emission signal;

a fifth transistor connected to the node D and the data line, and capable of being turned on by the second scan signal received through the second scan line; and a storage capacitor including a first electrode connected to the node A, and a second electrode connected to a node D.

4. The OLED display of claim 3, wherein:

in a (j−1)-th horizontal period during which the first scan signal is supplied to a (j−1)-th pixel row, a fourth transistor of each pixel arranged on the j-th pixel row initializes the node D in accordance with the emission signal, and first and third transistors of each pixel arranged on the j-th pixel row are turned on by the first scan signal, and a second transistor of each pixel arranged on the j-th pixel row is turned on by the emission signal, so that the node A is initialized to a reference voltage.

5. The OLED display of claim 4, wherein:

in a j-th horizontal period during which the first scan signal is supplied to the j-th pixel row, the first transistor of each pixel arranged on the j-th pixel row is turned on by the first scan signal and thereby establishes a diode connection of the nodes A and B, so that the node A is charged to a high-potential driving voltage which is supplied from the high-potential driving voltage input terminal.

6. The OLED display of claim 5, wherein, in the j-th horizontal period, a fifth transistor of each pixel arranged on the j-th pixel row is turned on by the second scan signal, so that the node D is charged to the data voltage.

7. The OLED display of claim 6, wherein, in a (j+1)-th horizontal period during which the first scan signal is supplied to a (j+1)-th pixel row, the fourth transistor of each pixel arranged on the j-th pixel row is turned on by the emission signal, so that the nodes D is charged to the reference voltage.

8. The OLED display of claim 7, wherein, in the (j+1)-th horizontal period, the second transistor of each pixel arranged on the j-th pixel row connects the nodes B and C in response to the emission signal, and wherein the OLED emits a light with a voltage variance of the node D being reflected to the node A when the j-th horizontal period proceeds into the (j+1)-th horizontal period.

9. The OLED display of claim 3, wherein at least one of the second to fifth transistors has a double-gate structure.

10. A driving method of an organic light emitting diode (OLED) display comprising: a display panel in which a plurality of pixels arranged on n number of pixel rows including a j-th pixel row, wherein n and j are integers and j is equal to or smaller than n, first to second scan lines connected to pixels in each pixel row, an emission line, a reference voltage line, and a data line are arranged; a gate driver that supplies first and second scan signals to the first and second scan lines, respectively, and that supplies an emission signal to the emission line; and a data driver that supplies a data voltage to the data line, wherein each of the plurality of pixels comprises: a driving Transistor (DT) including a gate electrode connected to a node A, a source electrode connected to a node B, and a drain electrode connected to a high-potential driving voltage input terminal; a first transistor connected to the node A and a node B, and capable of being turned on turned on by the first scan signal received through the first scan line; a second transistor connected to the node B and a node C connected to an anode electrode of an OLED, and capable of being turned on by the emission signal received through the emission line; a third transistor connected to the node C and the reference voltage line, and capable of being turned on by the first scan signal; a fourth transistor connected to the node D and the reference voltage line, and capable of being turned on by the emission signal; a fifth transistor connected to the node D and the data line, and capable of being turned on by the second scan signal received through the second scan line; and a storage capacitor including a first electrode connected to the node A, and a second electrode connected to a node D, the driving method comprising:

in a (j−1)-th horizontal period during which a scan signal is supplied to a (j−1)-th pixel row through its first scan line, a threshold voltage of a driving thin film transistor (TFT) of each pixel arranged on the (j−1)-th pixel row is sampled, and a voltage of a gate electrode of a driving TFT of each pixel arranged on the j-th pixel row is initialized;

in a j-th horizontal period during which the scan signal is supplied to the j-th pixel row through its first scan line, a threshold voltage of the driving TFT of each pixel arranged on the j-th pixel row is sampled, and a data voltage is charged in each pixel arranged on the j-th pixel row; and in a (j+1)-th horizontal period during which the scan signal is supplied to a (j+1)-th pixel row through its first scan line, an OLED in each pixel arranged on the j-th pixel row is caused to emit a light according to the data voltage charged.

* * * * *